United States Patent [19]

Stahl

[11] Patent Number: 4,944,472

[45] Date of Patent: Jul. 31, 1990

[54] APPARATUS FOR DISPENSING COILED ELECTRICAL WIRE OR CABLE

[75] Inventor: Ira R. Stahl, 3913 Lankenau Avenue, Philadelphia, Pa. 19131

[73] Assignees: Ira R. Stahl; John Siemiarowski, both of Philadelphia, Pa.

[21] Appl. No.: 247,212

[22] Filed: Sep. 21, 1988

[51] Int. Cl.[5] ..... B65H 49/00; B65H 16/00

[52] U.S. Cl. ..... 242/129; 242/85; 248/167

[58] Field of Search ..... 242/129, 115, 85; 248/163.2, 167

[56] References Cited

U.S. PATENT DOCUMENTS

| | | | |
|---|---|---|---|
| 314,428 | 3/1885 | Chaplin | 140/85 |
| 505,797 | 9/1893 | Wastall | 248/163.2 X |
| 535,617 | 3/1895 | Foster | 242/130.1 |
| 911,508 | 2/1909 | Look | 248/167 |
| 1,147,680 | 7/1915 | Crawford | 242/129 |
| 1,211,926 | 1/1917 | Dodd | 248/163.2 |
| 1,329,240 | 1/1920 | Hays | 242/77 |
| 1,675,241 | 6/1928 | Bacon et al. | 242/130.1 |
| 1,908,073 | 5/1933 | Spoor et al. | 242/129 |
| 2,027,325 | 1/1936 | Skelton | 242/110 |
| 2,135,913 | 11/1938 | Ralson et al. | 242/78 |
| 2,152,559 | 3/1939 | Moslo | 242/85 |
| 2,187,580 | 1/1940 | Young et al. | 242/78 |
| 2,197,180 | 4/1940 | Jenne et al. | 242/129 |
| 2,217,966 | 10/1940 | Perkins | 242/78 |
| 2,286,460 | 6/1942 | Brown | 242/128 |
| 2,390,158 | 12/1945 | Kramer | 242/128 |
| 2,562,650 | 7/1951 | Trunkhill | 242/129 |
| 2,630,980 | 3/1953 | Weaver | 242/129 |
| 2,673,045 | 3/1954 | Lewis | 242/128 |
| 2,673,046 | 3/1954 | Lewis | 242/128 |
| 2,828,091 | 3/1958 | Bell | 242/128 |
| 2,847,172 | 8/1958 | Salkield | 242/129 |
| 2,857,118 | 10/1958 | Rayburn | 242/128 |
| 2,871,057 | 1/1959 | Bernyk | 299/78 |
| 2,946,537 | 7/1960 | Bahnson, Jr. | 242/130.2 |
| 2,973,919 | 3/1961 | Goldrick et al. | 242/128 |
| 3,010,674 | 11/1961 | Dull et al. | 242/128 |
| 3,218,002 | 11/1965 | Derrickson et al. | 242/129 |
| 3,258,221 | 6/1966 | Derrickson et al. | 242/128 |
| 3,311,320 | 3/1967 | Taylor, Jr. | 242/128 |
| 3,447,448 | 6/1969 | Pasic | 100/4 |
| 3,556,431 | 1/1969 | Freitag | 242/129 |
| 3,575,358 | 6/1969 | Manner | 242/129 |
| 3,593,943 | 11/1969 | Collmann | 242/129 |
| 3,729,092 | 4/1973 | Marcell | 206/52 |
| 3,778,000 | 12/1973 | Breuner et al. | 242/77.2 |
| 3,837,597 | 9/1974 | Bourhenne | 242/129 |
| 3,974,980 | 8/1976 | Marcell | 242/128 |
| 3,990,653 | 11/1976 | Marcell | 242/129.8 |
| 4,015,795 | 4/1977 | Chong | 242/85 |
| 4,167,255 | 11/1979 | Benson | 242/129 |
| 4,471,921 | 9/1984 | Corbin | 242/129 |
| 4,611,645 | 9/1986 | Whisnant | 242/129 X |
| 4,741,492 | 5/1988 | Reysen | 242/129 |

OTHER PUBLICATIONS

Roper Reel Model 200 advertisement–The Roper Corporation, undated.

Residential Wire Dispenser Advertisement–Wyrecart, undated.

Hydon Catalogue 981–HyKon Manufacturing Company, undated.

The Electrical Advertiser, undated.

*Primary Examiner*—Stuart S. Levy

*Assistant Examiner*—E. Dunlap

*Attorney, Agent, or Firm*—Seidel, Gorda, Lavorgna & Monaco

[57] ABSTRACT

The cable dispenser generally comprises a collapsible stand, a collapsible reel and a hook which interconnects the reel and stand. The collapsible stand includes two inverted, generally U-shaped legs with an apex intermediate the ends of each leg. The legs are pivotably coupled together at their apexes. The legs are movable between a collapsed position in which the legs are alinged one over the other and an in use position in which the legs are crossed. The collapsible reel includes a flat base. A pair of inverted generally V-shaped rods are pivotably mounted to the base. The rods are movable between an in use position in which the rods stand upright on the base and a collapsed position in which the rods lie next to the base. The hook interconnects the reel and the stand, so that when the stand and the reel are in their respected in use positions, the reel rotates freely within the legs and when the stand and the reel are in their respective collapsed positioned, the apparatus is flat.

9 Claims, 3 Drawing Sheets

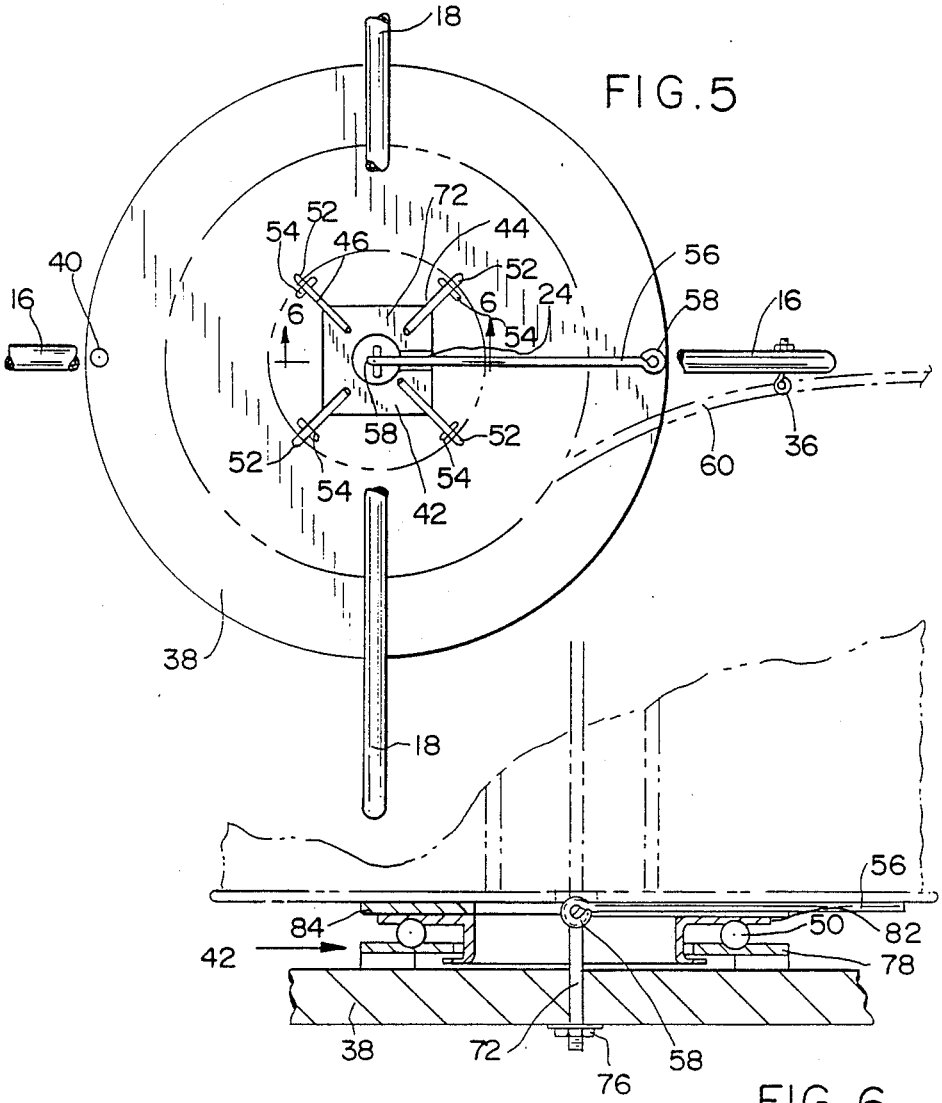
FIG. 5
FIG. 6
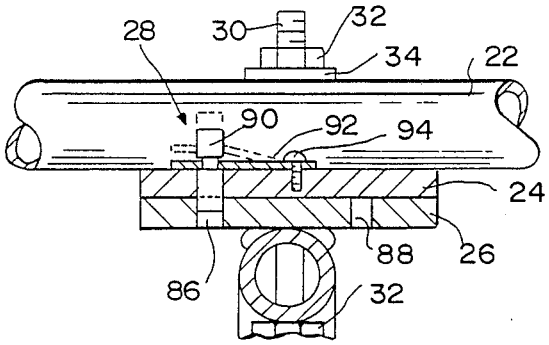
FIG. 7

APPARATUS FOR DISPENSING COILED ELECTRICAL WIRE OR CABLE

FIELD OF THE INVENTION

The instant invention is directed to an apparatus for dispensing coiled electrical wire or cable and includes a collapsible stand and a rotatable, collapsible reel which depends therefrom.

BACKGROUND OF THE INVENTION

Electrical cable, for example BX (metal jacket) or Romex (plastic jacket) electrical cable, is sold in coiled form. Bell wire or telephone wire is sold coiled on spools. When either the cable or wire is being run, that is put in place by an electrician, it must be uncoiled. Typically, when the cable is run it requires at least two men, one to pull the wire and one to take the wire off the coil. Needless to say this is a very inefficient use of labor.

Heretofore, attempts have been made to reduce the labor requirements involved in running cable or wire by utilizing wire dispensing apparatus. For example, U.S. Pat. Nos. 2,847,172; 3,593,943; 3,729,092; 3,837,594; 3,974,980; 4,015,795; and 4,167,255, each disclose coiled wire dispensing apparatus.

U.S. Pat. Nos. 2,847,172 and 3,593,943 are each directed to a coiled material dispenser which includes a base with a single upwardly standing shaft upon which a rotating reel depends. These dispensers have the disadvantage of not being collapsible, thus they are bulky and require space to store and transport.

U.S. Pat. Nos. 3,729,092 and 3,974,980 are each directed to wire dispensing reels comprising a flat circular base and a plurality of flexible suspending lines which at one end are fixed to the base and at the other end are joined together. A suspension hook is fastened to the lines where they are joined together. The suspension hook is secured to a rafter or pipe. These reels are designed for use on new construction projects, since they are to be suspended from exposed ceiling members. These reels are not designed for use in rewiring of existing construction.

U.S. Pat. Nos. 3,837,594 and 4,167,255 each disclose wire dispensers which are clamped to a stud. These dispensers are also designed for use in new construction projects since studs are normally not exposed in existing construction. Moreover, these devices do not work well when clamped into metal studs which are being used in commercial construction. The weight of the dispenser when loaded with the coiled wire can buckle a metal stud.

U.S. Pat. No. 4,015,795 is directed to a wire dispenser in which a rotatable spool sits on top of a table having a plurality of removable legs. While this dispenser is somewhat collapsible, i.e., the legs are removable, it is still bulky in its collapsed state.

Each of the foregoing devices can reduce the labor involved in running electrical cable, however, none of the devices have universal application. Some devices can only be used in new construction projects and are not suitable for use in rewiring existing construction. Others are bulky, therefore they require space to store and transport. Accordingly, there is a need for a wire or cable dispenser that saves labor and is usable in both new construction and existing construction.

SUMMARY OF THE INVENTION

The instant invention overcomes all the disadvantages noted above and provides a wire dispensing apparatus which may be used while wiring new construction or rewiring existing construction. Moreover, the instant invention is collapsible to a compact shape which requires little storage space and is readily transportable.

The cable dispenser generally comprises a collapsible stand, a collapsible reel and a hook which interconnects the reel and stand. The collapsible stand includes two inverted, generally U-shaped legs with an apex intermediate the ends of each leg. The legs are pivotably coupled together at their apexes. The legs are movable between a collapsed position in which the legs are aligned one over the other and an in use position in which the legs are crossed. The collapsible reel includes a flat base. A pair of inverted generally V-shaped rods are pivotably mounted to the base. The rods are movable between an in use position in which the rods stand upright on the base and a collapsed position in which the rods lie next to the base. The hook interconnects the reel and the stand, so that when the stand and the reel are in their respected in use positions, the reel rotates freely within the legs and when the stand and the reel are in their respective collapsed positions, the apparatus is flat.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 5 is a sectional, top plan view taken generally along lines 5—5 of FIG. 3.

FIG. 6 is an enlarged elevational view taken generally along lines 6—6 of FIG. 5.

FIG. 7 is an enlarged elevational view of a portion of the preferred embodiment illustrated in FIG. 3.

DETAILED DESCRIPTION OF THE INVENTION

Figure 1:
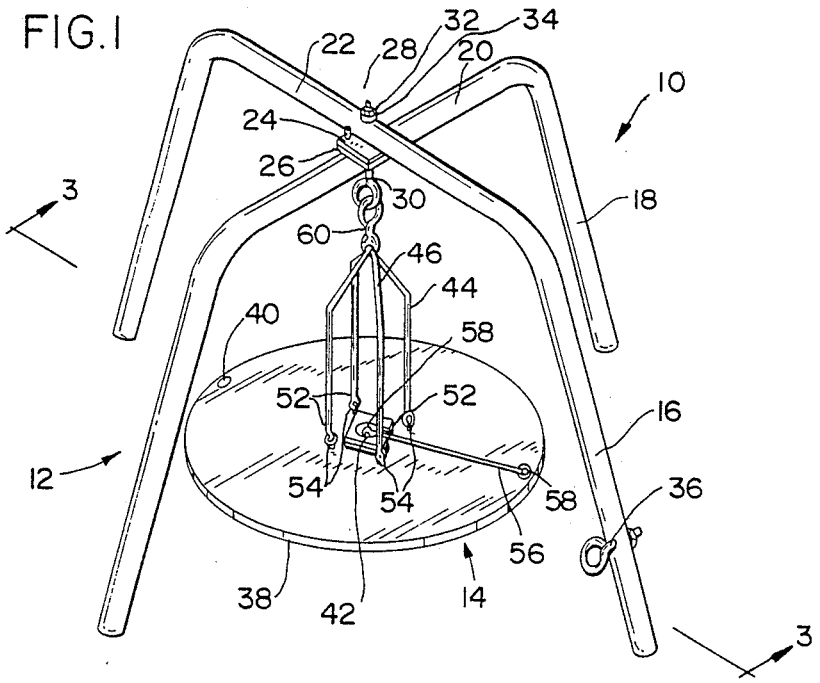
FIG. 1 is an isometric view of the preferred embodiment in its in use position.

Referring to the drawings wherein like numerals indicate like elements there is shown in FIG. 1 a preferred embodiment of a wire dispensing apparatus 10.

The terms, "cable" or "wire", are used generally to mean BX or Romex or any other electrical cable as well as bell wire, telephone wire, coaxial cable or the like. Apparatus 10 generally comprises a collapsible stand 12 and a collapsible reel 14 which are interconnected by a hook 60.

Stand 12 comprises two inverted generally U-shaped legs 16 and 18. The legs may be made from metal electrical conduit. Each leg 16 and 18 includes an apex 20, 22 respectively which is located intermediate the terminal ends of the leg. A rectangular plate 24 is affixed to the central portion of apex 22 on its lower surface. Rectangular plate 26 is affixed to the central portion of apex 20 on its upper surface. These plates are aligned over one another and provide stability to the stand. An eye bolt 30 pivotally interconnects legs 16 and 18 through their apexes so that the legs can be moved between an in use position and a collapsed position. The eye bolt 30 is secured to legs 16 and 18 via nut 32 and washer 34 located above and below legs 16 and 18. The eye bolt 60 is freely rotatable within legs 16 and 18 so that reel 14 can rotate. Additionally, eye bolt 30 acts as a pivot so that legs 16 and 18 may be moved between their in use and collapsed positions. The eye bolt extends downwardly below the apexes of the legs. A detent 28 which locks the legs in their in use and collapsed positions is mounted on plate 24. A guide 36, in the form of an eye bolt, is secured to leg 16 adjacent one of its ends.

Reel 14 includes a flat circular base 38. Base 38 includes a hole 40 therethrough which is located at the peripheral edge portion thereof. A turntable 42 is affixed to the center of base 38. A pair of inverted generally V-shaped rods are pivotally fastened to a central portion of base 38. Rods 44 and 46 include apexes 48 and 50 respectively. At the terminal ends of each rod 44 and 46 is an eye 52. Eyes 52 are connected to base 38 via eye screws 54. A straight rod 56 having eyes 58 at each end is movably secured to the center of base 38 by eye bolt 72. Rods 44, 46 and 56 are preferably made of metal so that they are inflexible.

Hook 60 has an eye 62 at one of its ends and a clasp 64 at its other end. Eye 62 engages and is rotatable with eye bolt 30. Clasp 64 engages apexes 48 and 50 of rods 44 and 46 when the stand and reel are in their in use positions or engages hole 40 when the stand and reel are in their collapsed positions. Clasp 64 also is adapted to engage the free eye 58 of rod 56.

Figure 2:
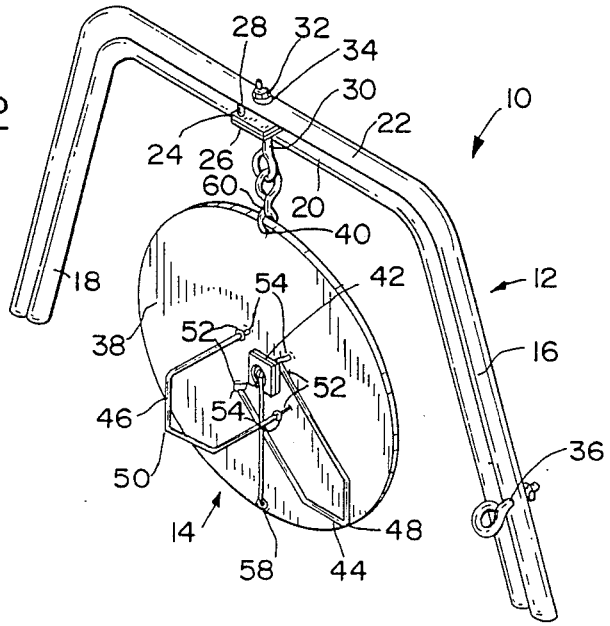
FIG. 2 is an isometric view of the preferred embodiment in its collapsed position.

FIG. 1 shows apparatus 10 in one of its in use positions. Legs 16 and 18 are open and, preferably, perpendicular to one another. Rods 44 and 46 are upstanding on base 38 and are engaged at their apexes 48, 50, in clasp 64 of hook 60. Reel 14 is freely rotatable within leg 16 and with rotatable eye 30. In FIG. 2, apparatus 10 is shown in its collapsed position. Legs 16 and 18 are aligned one over the other. Clasp 64 of hook 60 engages base 38 via hole 40. In the collapsed position, apparatus 10 assumes a generally flat shape so that it is easily transported and stored.

Figure 3:
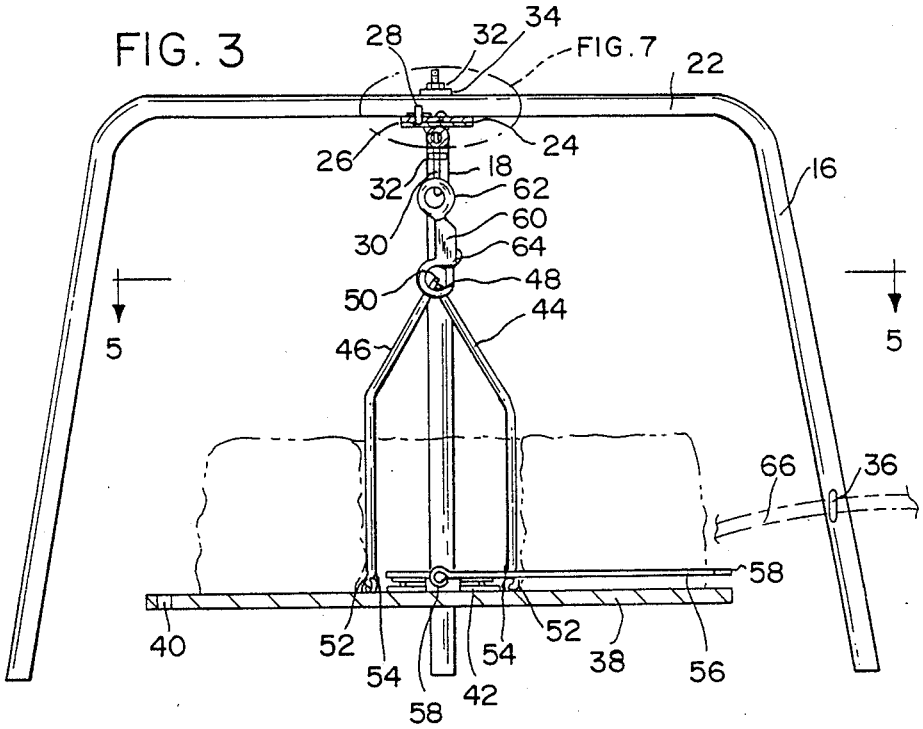
FIG. 3 is a sectional, elevational view taken generally along lines 3—3 of FIG. 1.
Figure 4:
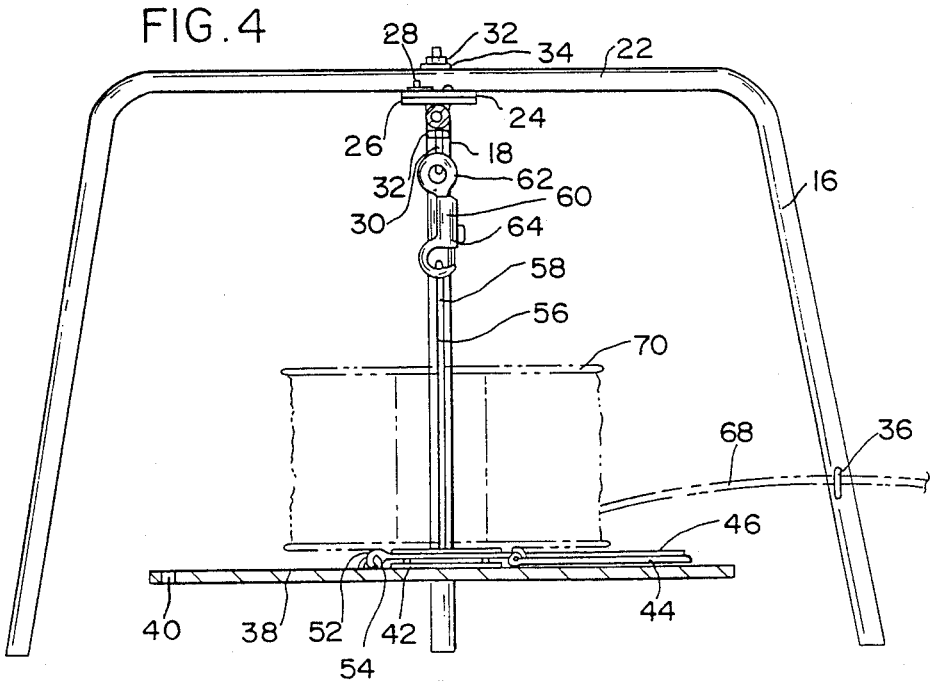
FIG. 4 is a sectional, elevational view of the preferred embodiment in use with bell wire.

FIGS. 3 and 4 illustrate two alternate in use positions of apparatus 10. In FIG. 3, coiled cable 66, for example Romex or BX cable, is placed about upstanding rods 44 and 46. Rod 56 lies next to base 38. The free end of cable 66 is threaded through guide 36 mounted on leg 16. In operation, the wire is pulled through guide 36 and off base 38. No man is needed to uncoil the cable, thus a labor saving is realized. Base 38 with spooled cable 66 resting thereon freely rotates with rotating eye 30. This configuration is stable, i.e. not easily tipped over, because the center of gravity is within legs 16, 18. In FIG. 4, spooled bell wire 68 on a spool 70 is placed on turntable 42 with rod 56 placed through the spool 70. Rod 56 is connected to clasp 64 of hook 60. Rods 44 and 64 lie next to base 38. Wire 68 is pulled through guide 36 and spool 70 is allowed to rotate on turntable 42. This configuration is also stable and does not require a man to uncoil the wire.

Referring to FIGS. 5 and 6, turntable 42 is shown in greater detail. Turntable 42 includes an annular plate 78 which is affixed to base 38. A flanged cylinder 82 is freely rotatable within annular plate 78 on ball bearings 80. An annular plate 84 with a radial slot 74 is mounted on the upper surface of flanged cylinder 82. Rod 56 lies within slot 74 when not used and is secured to base 38 by eye bolt 72 and nut 76.

Referring to FIG. 7, detent 28 is illustrated in greater detail. Detent 28 is used to lock leg 16 and 18 in their in use and collapsed positions. The detent 28 comprises a slidable pin 90, a leaf spring 92 and a bolt 94. Bolt 94 holds leaf spring 92 against upper plate 24. Lower plate 26 is provided with two slots 86 and 88. Slot 86 is the in use hole so that when pin 90 is biased into slot 86 via spring 92, leg 16 and 18 are locked in their crossed position. Slot 88 is located through plate 26 about 90 degrees from slot 86, so that when pin 90 is moved out of slot 86 and the legs are positioned one over the other, pin 90 may drop into slot 88 thereby locking legs 16 and 18 in their collapsed position.

The present invention may be embodied in other specific forms without departing from the spirit or essential attributes thereof and, accordingly, reference should be made to the appended claims, rather than to the foregoing specifications, as indicating the scope of the invention.

I claim:

1. An apparatus for dispensing spooled cable comprising:

a collapsible stand including two inverted generally U-shaped legs, each leg having an apex, said legs being pivotably connected at said apexes, said legs being movable between a collapsed position in which said legs are aligned one over the other and an in use position in which said legs are crossed;

a collapsible reel including a flat base, a pair of inverted generally V-shaped rods pivotably mounted to said base, said rods being movable between an in use position in which said rods stand upright on said base and a collapsed position in which said rods lie next to said base;

means for hooking said reel to said stand so that when said stand and said reel are in their respective in use positions, said reel rotates freely within said legs and when said stand and said reel are in their respective collapsed positions, the apparatus is flat.

2. The apparatus according to claim 1 wherein said reel further comprises a rod pivotally affixed to the center of said base and being engageable with said hook means.

3. The apparatus according to claim 1 wherein said reel further comprises a turntable affixed to the center portion of said base.

4. The apparatus according to claim wherein said stand further comprises a guide affixed adjacent a terminal end of one said leg.

5. The apparatus according to claim 1 wherein said stand further comprises a detent which locks said stand in said in use position and said collapsed position.

6. The apparatus according to claim 1 wherein said stand further comprises a rotatable eye which pivotally interconnects said legs and which said hook means engages when said stand and said reel are in their respective in use positions.

7. The apparatus according to claim 1 wherein said base includes a hole therethrough adjacent a peripheral edge of said base, said hook means engages said hole when said stand and said base are in their respective collapsed positions.

8. A collapsible reel adapted for dispensing spooled cable comprising:

a flat circular base;

a pair of inverted generally V-shaped rods pivotally mounted to a central portion of said base, said rods being movable between an in use position in which said rods stand upright on said base and a collapsed position in which said rods lie next to said base;

a turntable affixed to said central portion of said base; and a rod movably mounted to the center of said base.

9. The collapsible reel according to claim 8 further comprising said base having a hole therethrough adjacent a peripheral edge portion of said base.

* * * * *